US007866955B2

(12) United States Patent
Lilie et al.

(10) Patent No.: US 7,866,955 B2
(45) Date of Patent: Jan. 11, 2011

(54) SUCTION MUFFLER FOR A RECIPROCATING HERMETIC COMPRESSOR

(75) Inventors: Dietmar Erich Bernhard Lilie, Joinville-Sc (BR); Fabricio Caldeira Possamai, Joinville-Sc (BR)

(73) Assignee: Whirlpool S.A., Sao Paulo-Sp (BR)

( * ) Notice: Subject to any disclaimer, the term of this patent is extended or adjusted under 35 U.S.C. 154(b) by 662 days.

(21) Appl. No.: 10/494,403

(22) PCT Filed: Oct. 29, 2002

(86) PCT No.: PCT/BR02/00145

§ 371 (c)(1),
(2), (4) Date: Jul. 26, 2004

(87) PCT Pub. No.: WO03/038280

PCT Pub. Date: May 8, 2003

(65) Prior Publication Data

US 2005/0031461 A1 Feb. 10, 2005

(30) Foreign Application Priority Data

Oct. 29, 2001 (BR) ..... 0105694

(51) Int. Cl.
*F04B 39/00* (2006.01)
*F04B 53/00* (2006.01)

(52) U.S. Cl. ..... 417/312; 181/403

(58) Field of Classification Search ..... 417/312, 417/902, 360, 313; 181/403, 229
See application file for complete search history.

(56) References Cited

U.S. PATENT DOCUMENTS

| | | | | | |
|---|---|---|---|---|---|
| 2,133,875 | A | * | 10/1938 | Steenstrup | 417/312 |
| 4,793,775 | A | * | 12/1988 | Peruzzi | 417/312 |
| 5,201,640 | A | * | 4/1993 | Heinzelmann et al. | 417/312 |
| 5,584,674 | A | * | 12/1996 | Mo | 417/312 |
| 5,647,314 | A | * | 7/1997 | Matsumura et al. | 123/184.57 |
| 5,971,720 | A | * | 10/1999 | Fagotti et al. | 417/312 |
| 6,017,197 | A | * | 1/2000 | Jensen et al. | 417/312 |
| 6,155,800 | A | * | 12/2000 | Todescat et al. | 417/312 |
| 6,520,289 | B1 | * | 2/2003 | Bo | 181/229 |
| 7,147,082 | B2 | * | 12/2006 | Lilie et al. | 181/262 |
| 2002/0076335 | A1 | * | 6/2002 | Silveira et al. | 417/312 |

FOREIGN PATENT DOCUMENTS

| | | | |
|---|---|---|---|
| EP | 195486 | * | 9/1986 |
| EP | 195486 A2 | * | 9/1986 |

* cited by examiner

*Primary Examiner*—Devon C Kramer
*Assistant Examiner*—Peter J Bertheaud
(74) *Attorney, Agent, or Firm*—Gifford, Krass, Sprinkle, Anderson & Citkowski, P.C.

(57) ABSTRACT

A suction muffler for a small refrigeration system, the muffler including an enclosed equalizing chamber acting upon a tubular connector and a fluid communication between the equalizing chamber and an acoustic chamber. The assembly simultaneously minimizes the noises of gas pulses inside the suction muffler and the pressure differential between the inside and outside of the tubular connector.

5 Claims, 4 Drawing Sheets

SUCTION MUFFLER FOR A RECIPROCATING HERMETIC COMPRESSOR

FIELD OF THE INVENTION

The present invention refers to a suction muffler to be mounted at the refrigerant gas supply region in a reciprocating hermetic compressor, particularly in a reciprocating hermetic compressor of direct suction used in small refrigeration systems.

BACKGROUND OF THE INVENTION

Reciprocating hermetic compressors have their suction provided with an acoustic dampening system (acoustic filters or suction mufflers) provided inside the shell and which conducts the gas coming from the suction line to the suction valve.

This component executes several functions that are important to the adequate operation of the compressor, such as gas conduction, acoustic dampening and, in some cases, thermal insulation of the gas that is drawn to the inside of the cylinder.

The suction muffler generally consists of a sequence of volumes and tubes that conduct the gas coming from the suction line directly to the suction valve. This gas displacement produces pulses, generating noises that are propagated in an opposite direction to the gas flow toward the suction valve. The more efficient the suction muffler at its acoustic outlet, the lower will be said pulses.

Another important function of the suction muffler is to conduct the gas to the suction valve with the least possible heating, avoiding thermal exchanges with the gas stagnated inside the compressor shell and also reducing its contact with the hot parts inside the compressor. On the other hand, the suction muffler represents a load loss to the gas flow being drained. Its influence on the performance of the compressor is highly important. The suction mufflers are mostly constructed in a material of low thermal conductivity and affixed to the compressor head through the cylinder cover. The dimensioning of the internal volumes of the suction muffler tubes determines, to a great extent, the efficiency of the latter.

In some known constructions for the compressors of refrigeration systems, the gas suction occurs by direct suction from the inlet tube to the inside of the suction muffler. In these constructions, the suction line is maintained in fluid communication with the suction muffler through a flexible connector that conducts the cold suction gas directly to the interior of the muffler, minimizing the thermal exchanges of this cold gas with the gas stagnated inside the shell. This connection can be constructed in a flexible material of low thermal conductivity and retained to the suction muffler and in a sliding contact with the compressor shell, such as it occurs in the solution described in U.S. Pat. No. 4,793,775.

In this type of prior art construction, the flexible connector works adequately during the normal operation of the compressor, directing the cold gas from the suction line to the suction valve, without submitting this incoming gas flow to be mixed with the heated gas contained in the compressor shell, and also minimizing the transfer, to the shell, of the noises resulting from the gas pulses inside the suction muffler.

However, this known construction presents the inconvenience of not allowing the refrigeration system to rapidly and adequately return to the pressure levels of the normal working regimen of the compressor, when the latter is driven after a stop period in which the pressure inside the shell is raised to a value of equilibrium with the suction and discharge sides of the compressor.

When the compressor is re-started, the pressure inside the suction muffler and inside the flexible connector is suddenly reduced, originating a pressure differential that is greater than the stop pressure inside the compressor shell, causing a certain collapse of the flexible connector and the compressor assembly tilts toward the shell, compressing the flexible connector and submitting it to undesirable efforts as long as the strong pressure unbalance condition lasts between the interior of the shell and the interior of the suction muffler. Since the latter is constructed, in case of the direct suction, to be relatively hermetically coupled to the inlet of the suction muffler and to the shell, the pressure inside the latter remains high in relation to the interior of the suction muffler for a long period, during which the flexible connector remains resiliently deformed and inadequately subjected to undesirable efforts that tend to damage it or displace it from its operative position.

OBJECTS OF THE INVENTION

It is an object of the present invention to provide a suction muffler for a reciprocating hermetic compressor with direct suction, which does not present the inconveniences of the known prior art solutions, producing a fast and efficient equalization of the pressures existing inside the shell and inside the suction muffler, without submitting the elements of the direct suction to undesirable efforts and without causing loss in the volumetric efficiency of the compressor.

It is another object of the present invention to provide a suction muffler as mentioned above, which produces a better attenuation of the noises produced by the gas pulses inside the suction muffler.

It is a further object to provide a suction muffler, which, besides the above characteristics, allows for a better fixation of the connector to the gas inlet thereof.

SUMMARY OF THE INVENTION

These and other objects are achieved by a suction muffler for a reciprocating hermetic compressor mounted inside a hermetic shell, said suction muffler comprising a hollow body that defines at least one acoustic chamber and that is provided with a gas inlet connected to a suction line by means of a flexible connector, and with a gas outlet connected to a suction valve of the compressor, said suction muffler comprising an equalizing chamber, which is provided, on one side, with an opening to the inside of the hermetic chamber and, on the other side, with a fluid communication with the acoustic chamber, said equalizing chamber and said fluid communication being dimensioned so as to minimize, simultaneously, the transfer of acoustic energy to the cavity of the shell, the mixture of said gas with that contained inside the hermetic shell, and the pressure differential between the inside of the latter and the suction line, upon operation of the compressor after a stop period.

BRIEF DESCRIPTION OF THE DRAWINGS

The invention will be described below, with reference to the attached drawings, in which.

DESCRIPTION OF THE ILLUSTRATED EMBODIMENT

Figure 1:
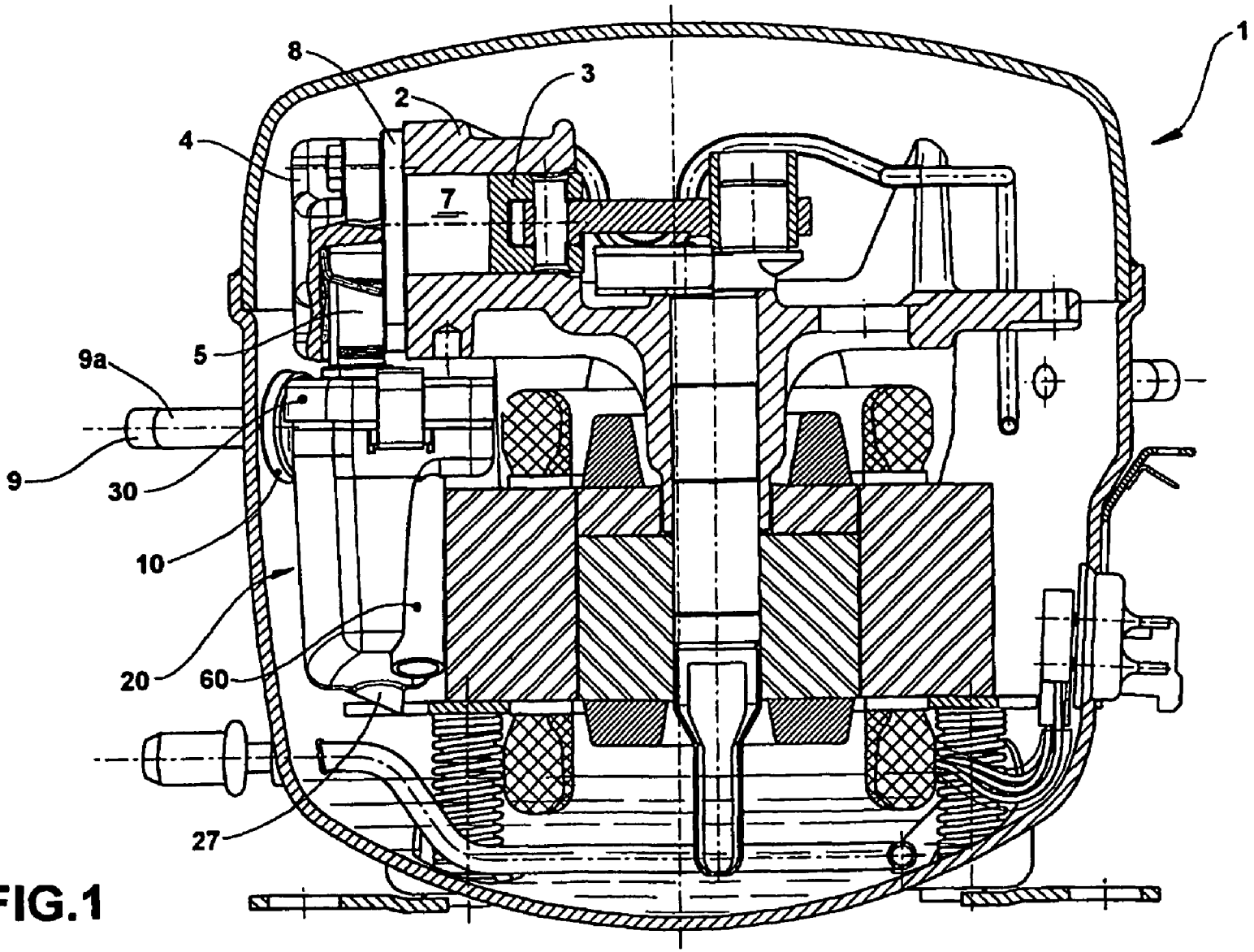
FIG. 1 shows, schematically, a longitudinal sectional view of a compressor presenting a direct suction between an inlet tube and a suction muffler, constructed according to the present invention, using a connector affixed to said suction muffler.
Figure 2:
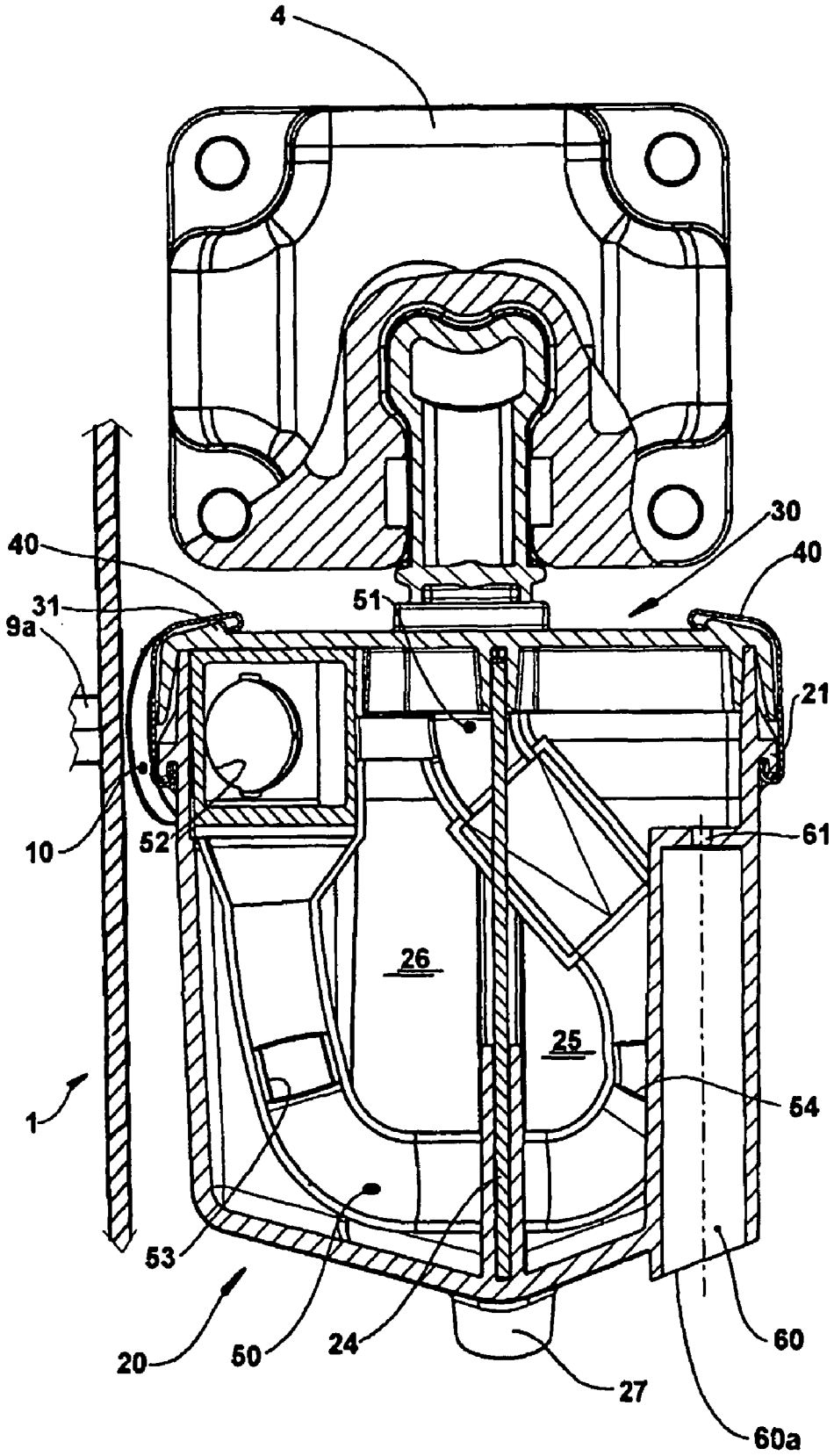
FIG. 2 shows, schematically and in a longitudinal sectional view, the suction muffler in FIG. 2 mounted inside the hermetic shell of the compressor.
Figure 3:
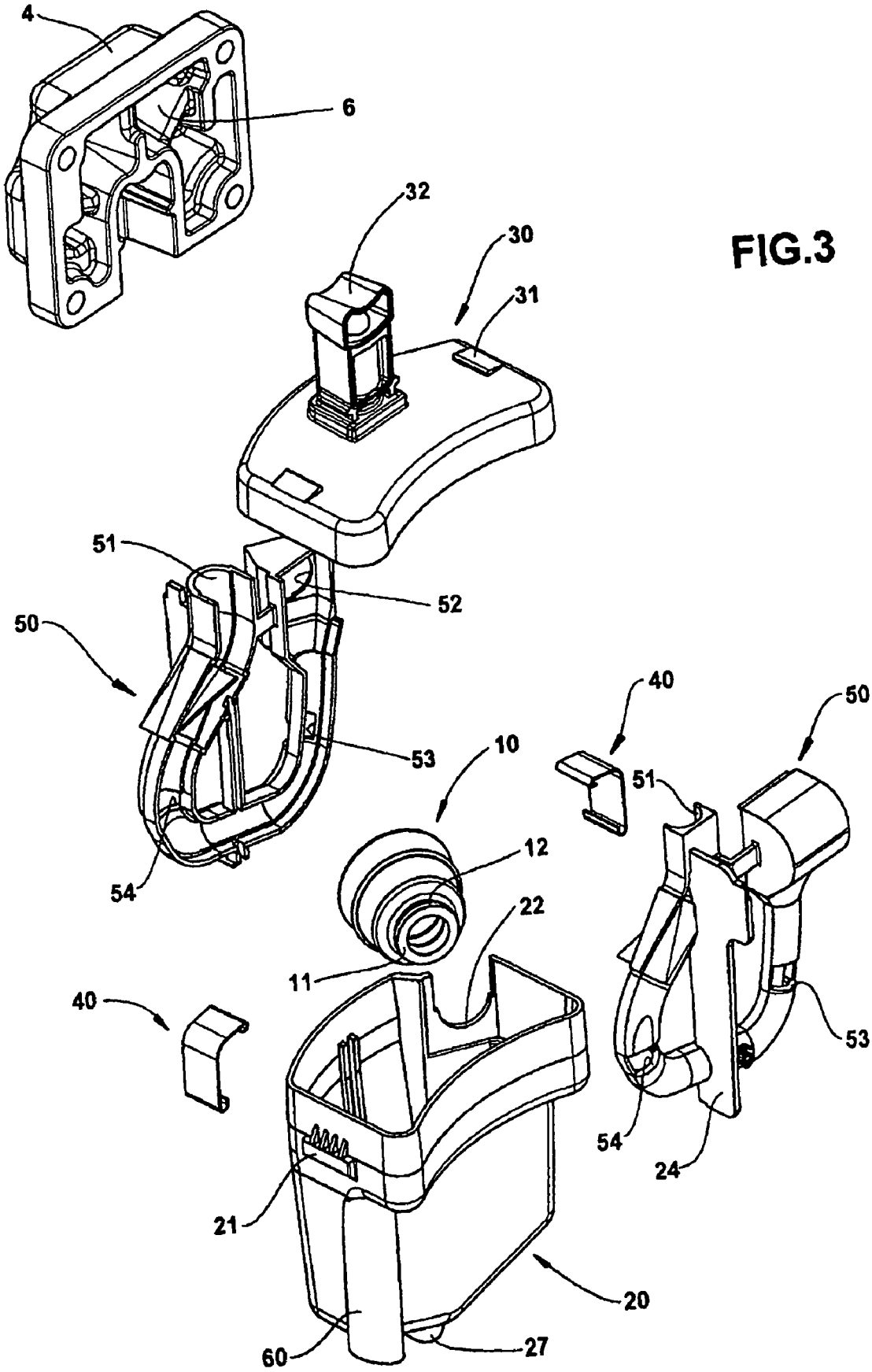
FIG. 3 shows, schematically and in an exploded perspective view, the suction muffler of the present invention and a connector to be affixed to an inlet thereof, when in the mounting condition.
Figure 4:
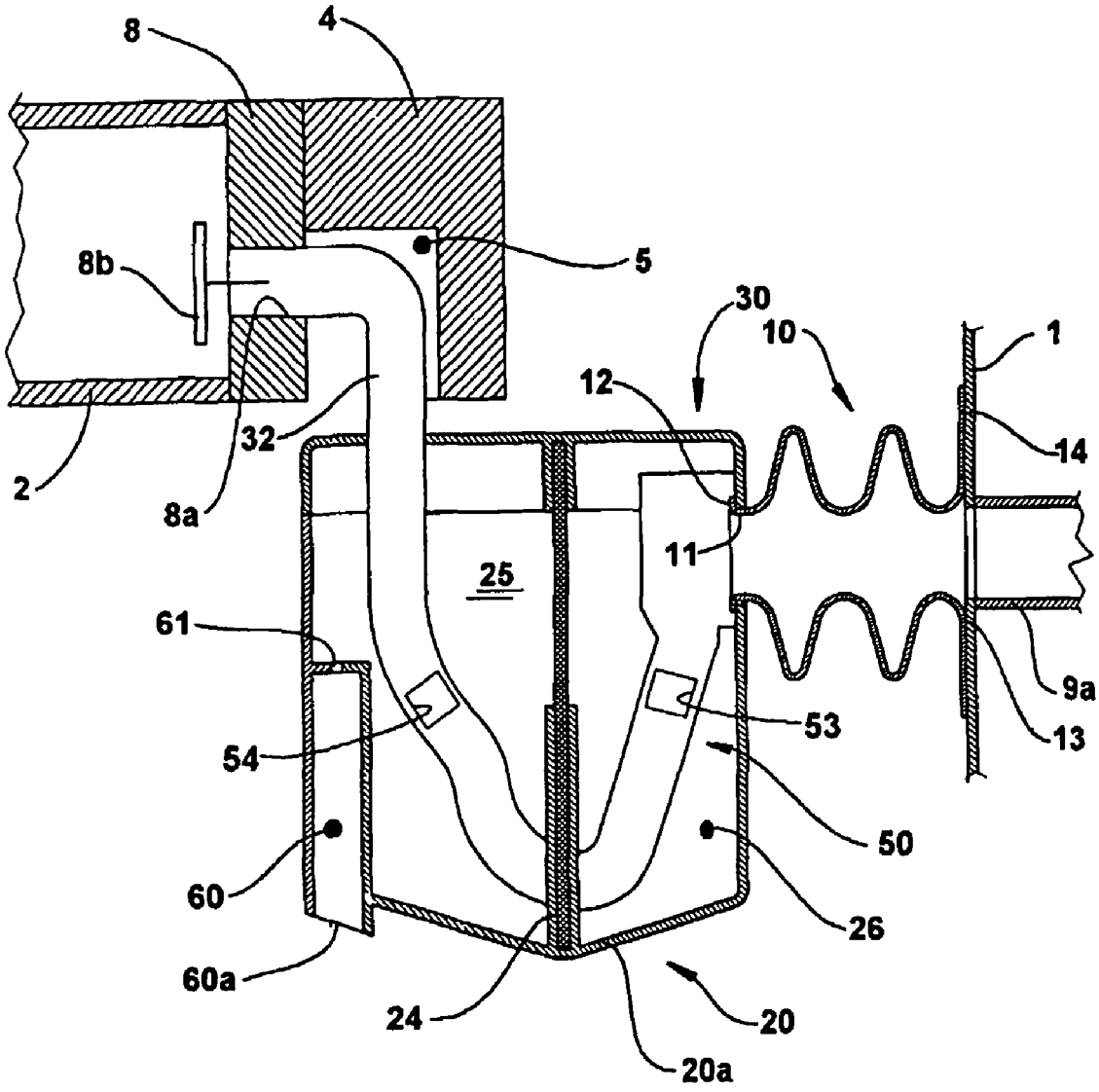
FIG. 4 shows, schematically and in a longitudinal sectional view, the suction muffler of the present invention, presenting the connector seated on the hermetic shell and opened to the interior of the suction muffler conducting tube.

The present invention will be described for a compressor of the type used in refrigeration systems and comprising: inside a hermetic shell 1, a motor-compressor assembly having a cylinder block where is defined a cylinder 2 lodging, at one end, a reciprocating piston 3, and having an opposite end closed by a cylinder cover 4 defining therewithin a housing 5 for adaptation of the suction muffler, and a discharge chamber 6 (FIG. 3) in selective fluid communication with a compression chamber 7 defined inside the cylinder 2 between a top portion of the piston 3 and a valve plate 8 provided between the opposite end of the cylinder 2 and the cylinder cover 4, through suction orifices 8*a* and discharge orifices (not illustrated), which are provided on said valve plate 8 and selectively respectively closed by suction valves 8*b* and discharge valves (not illustrated).

According to the illustrations, the gas drawn by the compressor and coming from a suction line 9 of the refrigeration system and opened to the inside of the hermetic shell 1, reaches the latter through an inlet tube 9*a* affixed to the external side of said hermetic shell 1 and which is in fluid communication with the suction muffler mounted inside said hermetic shell 1, through a tubular connector 10 of flexible material, said suction muffler being mounted in the housing 5 in fluid communication with the suction valve 8*b* of the valve plate 8.

As illustrated in the enclosed drawings, the suction muffler of the present invention comprises a hollow body 20, which is generally obtained from a material of low thermal conductivity and presents a rectangular cross section, for example, and which is closed by an upper cover 30 to be seated onto the upper edge of the hollow body 20 and there affixed by any adequate means, such as for example, a pair of clamps 40 that are fitted, by elastic deformation, into respective ears 21 and 31 provided in the hollow body 20 and in the cover 30.

According to the present invention, the tubular connector 10 incorporates, at one end 11, a first peripheral flange 12 that is seated and retained inside the hollow body 20 by joining respective portions of the latter and of the upper cover 30 and, at an opposite end 13, a second peripheral flange 14 that is seated against the internal face of the hermetic shell 1 concentrically with the suction line 9.

The hollow body 20 is provided with a gas inlet 22 in fluid communication with the gas supply to the compressor and which is aligned to the suction inlet tube 9*a* of the suction line 9, and with a gas outlet 32 in fluid communication with a suction side of the compressor and connected to the suction valve 8*b* of the compressor. In the construction being described, the gas inlet 22 is defined by the junction of the hollow body 20 and the upper cover 30, and the gas outlet takes the form of a tubular extension that is superiorly and externally incorporated to the cover 30 and has a free end configured to be adapted to the suction orifice 8*a* of the valve plate 8 of the cylinder cover 4 of the hermetic compressor.

According to the present invention, the hollow body 20 defines, in the interior thereof, at least one, for example two acoustic chambers, which are separated from each other by a common wall portion defined by a dividing plate 24 provided inside said hollow body 20, as described ahead.

The present suction muffler comprises a first acoustic chamber 25 in fluid communication with the gas outlet 32 of said hollow body 20, and a second acoustic chamber 26 in fluid communication with the gas inlet 22 of the suction muffler, said first and second acoustic chambers 25, 26 being separated from each other by the dividing plate 24.

According to the illustrations, the hollow body 20 is provided, in a lower wall 20*a*, with a restricting orifice 27 by which the lubricant oil flows down and which is dimensioned to allow the passage of oil only, avoiding the heated oil existing inside the shell 1 from reaching the interior of the suction muffler and increasing the temperature of the gas therein.

The present suction muffler further presents a conducting tube 50 having a first end 51 opened to the gas outlet 32 of the hollow body 20, and a second end 52 opened to the gas inlet 22 of the hollow body 20, said conducting tube 50 presenting median portions that are respectively opened to the first and the second acoustic chambers 25, 26 of the hollow body 20. The conducting tube 50 presents at least one window 54 opened to the first acoustic chamber 25 and through which is effected the direct fluid communication between said first acoustic chamber 25 and the gas outlet 32 of the hollow body 20, and also at least one window 53 opened to the second acoustic chamber 26 of the hollow body 20 and through which is effected the direct fluid communication between the second acoustic chamber 26 and the gas inlet 22 of the hollow body 20. In the illustrated construction, the conducting tube 50 has two pieces and carries, on one of these pieces, the dividing wall 24 that defines the separation between the first and the second acoustic chambers 25, 26.

According to the present invention, the hollow body 20 presents, internally, an equalizing chamber 60, which is provided, on one side, with an opening 60*a* to the inside of the hermetic shell 1 and, on the other side, with a fluid communication 61 having an acoustic chamber, said equalizing chamber 60 and said fluid communication 61 being dimensioned to minimize, simultaneously, the noises from the gas pulses inside the suction muffler, the mixture of said gas with that contained inside the hermetic shell 1, and the pressure differential between the exterior of the hermetic shell 1 and the suction line, upon operation of the compressor after a stop period.

The equalizing chamber 60 is dimensioned to have only one portion of its internal volume defined adjacent to the fluid communication 61, which portion is alternatively filled with the gas coming from the acoustic chamber, particularly from the first acoustic chamber 25, and only filled with the gas coming from the remaining internal volume of the equalizing chamber 60 upon operation of the compressor. Thus, the gas contained in the hermetic shell 1 cannot reach the interior of the acoustic chamber through the fluid communication 61 during the normal operation of the compressor. Said internal volume of the equalizing chamber 60 presents a cross section that coincides with the cross section of the equalizing chamber 60 along the extension of said internal volume portion.

According to the illustrations, the equalizing chamber 60 presents an elongated shape, with an end opened to the acoustic chamber, and an opposite end opened to the interior of the hermetic shell 1, the opening of the equalizing chamber 60 to the interior of the hermetic shell 1 presenting a contour that coincides with that of the equalizing chamber 60 at the region of said opening.

According to the present invention, the fluid communication 61 is provided adjacent to the gas outlet 32 of the hollow body 1 and it is defined, for example, by an orifice provided in a wall that is common to both the acoustic chamber and the equalizing chamber 60.

The invention claimed is:

1. A suction muffler for a reciprocating hermetic compressor mounted inside a hermetic shell, said suction muffler comprising:

a hollow body defining at least one acoustic chamber, said at least one acoustic chamber having a lower wall provided with a restricting orifice for draining oil;

the hollow body being provided with a gas inlet connected to a suction line by means of a tubular connector and a gas outlet connected to a suction valve of the compressor;

the hollow body further comprising an equalizing chamber having an opening to the interior of the hermetic shell on one side, and a fluid communication with the acoustic chamber on the other side;

wherein said equalizing chamber has an elongated shape and an internal volume with a cross section that is substantially uniform along the extension of said internal volume, the fluid communication being defined by a second orifice provided adjacent to the gas outlet of the hollow body, said second orifice being disposed in a wall different from the lower wall of the hollow body and common to only the acoustic chamber and the equalizing chamber;

wherein the equalizing chamber and said second orifice are dimensioned to prevent gas contained inside the hermetic shell from entering the acoustic chamber, said equalizing chamber having only one portion of its internal volume, defined adjacent to the second orifice, alternatively filled with the gas coming from the acoustic chamber and with the gas coming from the remaining internal volume of the equalizing chamber upon normal operation of the compressor; wherein said equalizing chamber opening being dimensioned to allow said remaining internal volume of the equalizing chamber to be filled with gas from the inside of the hermetic shell; and wherein the equalizing chamber and said second orifice are also dimensioned to minimize the noises from the gas pulses inside the suction muffler, the mixture of said gas with the gas contained within the hermetic shell, and the pressure differential between the exterior of the hermetic shell and the suction line, upon operation of the compressor after a stop period.

2. The suction muffler as set forth in claim 1, wherein the hollow body defines, internally, first and second acoustic chambers and a conducting tube with its opposite ends respectively connected to the gas inlet and the gas outlet of the hollow body, and with median portions respectively opened to the first and the second acoustic chambers, the first acoustic chamber being adjacent to the gas outlet of the hollow body.

3. The suction muffler as set forth in claim 1, wherein the tubular connector is in a flexible material and incorporates, at one end, a first peripheral flange that is seated and retained inside the hollow body and, at an opposite end, a second peripheral flange seated against the internal face of the hermetic shell concentrically with the suction line.

4. The suction muffler as set forth in claim 3, wherein the gas inlet is formed by the junction of the hollow body with an upper cover, said first peripheral flange being retained by respective portions of the hollow body and of the upper cover.

5. The suction muffler as set forth in claim 1, wherein the fluid communication is separate from the gas inlet.

* * * * *

UNITED STATES PATENT AND TRADEMARK OFFICE

CERTIFICATE OF CORRECTION

PATENT NO. : 7,866,955 B2
APPLICATION NO. : 10/494403
DATED : January 11, 2011
INVENTOR(S) : Dietmar Erich Bernhard Lilie It is certified that error appears in the above-identified patent and that said Letters Patent is hereby corrected as shown below:

Column 3, line 29, replace “8b” with --8a--

Column 4, line 27, replace “54” with --53--

Column 4, line 27, replace “53” with --54--

Signed and Sealed this
Twenty-sixth Day of April, 2011

David J. Kappos
*Director of the United States Patent and Trademark Office*